United States Patent [19]

Schmodde et al.

[11] Patent Number: 4,729,230

[45] Date of Patent: Mar. 8, 1988

[54] CAM SYSTEM FOR FLAT-BED KNITTING MACHINE

[75] Inventors: Hermann Schmodde, Albstadt; Franz Schmid, Bodelshausen, both of Fed. Rep. of Germany

[73] Assignee: H. Stoll GmbH & Co., Fed. Rep. of Germany

[21] Appl. No.: 922,487

[22] Filed: Oct. 23, 1986

[30] Foreign Application Priority Data

Oct. 23, 1985 [DE] Fed. Rep. of Germany ..... 3537612

[51] Int. Cl.[4] ..... D04B 7/10

[52] U.S. Cl. ..... 66/70; 66/78; 66/76

[58] Field of Search ..... 66/64, 70, 67, 76, 73, 66/75.2, 78

[56] References Cited

U.S. PATENT DOCUMENTS 4,474,037 10/1984 Kuhnert ..... 60/78
4,545,219 10/1985 Schmodde ..... 66/70
4,616,488 10/1986 Schmodde ..... 66/70

*Primary Examiner*—Ronald Feldbaum
*Attorney, Agent, or Firm*—Jones, Tullar & Cooper

[57] ABSTRACT

A cam system for flat-bed knitting machines has a needle cam unit which has at least one integrated knitting cam loop transferring cam for both knitting and loop transferring directions, of which the knitting cam has adjustable sinker elements on both sides and the loop transferring cam has transfer cam parts with a central lobe, located above the knitting track, for transferring the loops and receiving cam parts associated with them having a central receiving lobe and an oblique face that is operative in a trailing fashion. The cam system also has a depressor apparatus, in which the needles supported in needle tracks of the needle beds are controlled by pressure jacks acting upon needle jacks, the pressure feet of the pressure jacks being movable into different tracks, which are located in the planes of pressure strips. Other than the already present and movable sinker elements for sinking movements, this cam system has no further moving parts nor additional width, is intended to enable more-advantageous and more-reliable loop transfer by proving that lobes for pre-tensing the loops are provided for the transfer cam parts, and the receiving cam parts permit a substantially later retraction of the receiving needles as compared with the transferring needles. To this end, leading ahead of the lobe for transferring the loops there is a lobe for pre-tensing the loops on the associated sinker element, which lobe is operative in the lowered position of the sinker element. The sinker element is embodied and disposed relative to the transfer cam part in such a way that in the leading position, in the lowered position, it defines the projection track for the transfer cam part and in the trailing position, in a position raised to the level of the ridge or in the sinking position, beginning at the lobe for transferring the loops, it completely defines the retractor track section of the transfer track. The trailingly operative oblique face of a fixed cam at a given time of the receiving cam part is disposed at the same level as the receiving lobe and leads at the same level out of the receiving track along a substantially horizontal track, which because of a trailingly operative pressure strip extends to beynd the outer flank of the trailing sinker element.

5 Claims, 7 Drawing Figures

CAM SYSTEM FOR FLAT-BED KNITTING MACHINE

FIELD OF THE INVENTION

The present invention relates to a cam system for flat-bed knitting machines having a needle cam unit with at least one knitting cam and one loop transferring cam, integrated therein, for both carriage travel and loop transferring directions. The knitting cam has sinker elements that are adjustable on opposite sides and the loop transferring cam has transfer cam elements having a central lobe disposed above the knitting track for transferring the loops, and associated receiving cam parts with elements having a central receiver lobe and an oblique face that comes into play in a trailing manner. The cam system also has a depressor apparatus, in which the needles, supported in needle tracks of the needle beds, are controlled by pressure jacks acting upon needle jacks. The pressure feet of the pressure jacks are movable into different tracks, which are located in the planes of a pressure strip.

BACKGROUND OF THE INVENTION

A cam system of this kind, for flat-bed knitting machines, of which the knitting cam is embodied with an integrated loop transferring cam for both carriage travel and loop transferring directions, and which is provided with a depressor apparatus, is known from German Offenlegungsschrift No. 33 15 283 (FIG. 9). In this known cam system, a great number of moving cam parts are provided, which despite the depressor apparatus must necessarily be indexed so as to enable selective operation of the needle cam unit, namely knitting, transfer, reception, tucking (that is, the position assumed between, successive knitting operations) and non-knitting. Mechanically and electrically, this is relatively complicated and expensive. Moreover, for the sake of symmetry, a lobe of protrusion for biasing or pre-tensioning the loops during transfer has been omitted in this cam system. In this known cam system the receiving needles are retracted in the usual manner, simultaneously with or even earlier than the transferring needles, which disadvantageously affects the loop transferring operation.

SUMMARY OF THE INVENTION

It is accordingly an object of the present invention to provide a cam system for flat-bed knitting machines, of the above-described general type, which has no further movable cam parts except for the already existing movable sinker elements for loop transferring, and which, although no wider in structure, nevertheless enables more advantageous and more reliable loop transfer, because lobes for pre-tensioning the loops are provided on the transfer cam elements, and the receiving cam elements make it possible to retract the receiving needles substantially later than the transferring needles.

This object is attained in accordance with the invention as described herein.

The sinker elements provided in the cam system according to the invention have the task not only of loop drawing, as in the prior art, but also, subsequent to that, of projecting the needles for the transfer movement and also of forming the track for the retraction of the needles that have completed the transfer movement. Thus aside from moving sinker elements that are necessarily provided, no other moving and hence indexable cam elements need to be provided, although this means that the loop must be pre-tensioned prior to the transfer. Furthermore, reception by the receiving needle is done more gently, because these needles can remain at the level of the receiving lobe and are not retracted until the other side of the trailing sinker element, that is, at the time when the transfer needle has long since been retracted to its position in which the curvature of its head is tangent to the knock-over edge of the knock-over comb. This does not make the needle cam unit any wider.

From German Offenlegungsschrift No. 33 34 040, now also U.S. Pat. Nos. 4,545,219 and 4,616,488, it is known, in a cam system having a needle cam unit and a pusher cam unit, to use the leading sinker element at any given time for pre-tensioning the loop upon transfer; however, in this case the needle cam unit is structurally wider, because two transfer lobes are provided for each adjacent pre-tensioning lobe. A separate, fixed cam element, which defines the track for retracting the transferring needle, is therefore provided for the transfer lobe.

To enable advantageous retraction of the transfer needle at least in the end phase via the retraction track of the knitting needle, an exemplary embodiment of the present invention includes an oblique face in the retraction track of the transfer lobe, prior to its entry into the retraction track portion of the knitting track; this oblique face changes to a track element located not as low as the knitting track, to make it possible to overcome the limiting edge of the knitting track at the entry.

In order to provide a transition from the leading pre-tensioning lobe on the sinker element to the transfer lobe in an advantageous manner, in a further exemplary embodiment of the present invention the sinker element is provided with a protrusion, forming a plunge sinker that trails after the pre-tensioning lobe; in the lowered position of the sinker element this protrusion closes the retraction track, and in the raised position of the sinker element it is disposed above the transfer lobe. By this means, this protrusion at the same time defines the entry into the retraction path for the transferring needle.

In the case of so-called depressor cams, the needle is typically coupled with a butt that can be lowered into the needle bed and is secured to a needle jack, for example, which in turn can be acted upon by the already-mentioned pressure jack. To provide a simple structure for the sinker elements and the adjacent fixed cam elements, in a further exemplary embodiment of the present invention the sinker element is provided, in its upper portion having the protrusion with an undercut which in the raised position of the sinker element is engaged by a fixed cam element that contributes to forming the transfer track. In other words, the sinker element is embodied such that in its raised position it can overlap the fixed transfer cam element that contributes to forming the pre-tensioning cam, so that it is unuecessary to enlarge the needle cam unit or the carriage.

On the other hand, from the above-mentioned German Offenlegungsschrift No. 33 15 283, it is known to effect movement control of the needles in the needle cam at least partly by means of one standard-height and one half-height butt of the needle jack that can be lowered into the needle bed. The standard-height butt effects the retraction movement, and the half-height butt, in this known cam system, effects the projection movement substantially entirely by itself. This also makes it necessary to have a plurality of cams such that they have various heights and are movable or indexable. To enable using the cam system according to the invention also in cases where the control of the needle movement is effected by the needle jack butts and by the half-height needle butts as well, in a further exemplary embodiment of the present invention the half-height butt is disposed lower or sunken in the needle bed, and the needle bed is provided with a recess for the half-height butt along one working area, which recess is engaged during the longitudinal movement of the carriage by a bridge-like, fixed transfer cam element, which is located spaced apart from and facing the sinker elements and the transfer cam part having the transfer lobe. This means that the half height butt comes into play only where the leading pre-tensioning lobe must pass through the insertion sinker. This also means that only a single cam part has to be embodied with a greater height, and therefore the half-height butt can pass unhindered underneath all the other cam parts Further details and embodiments of the invention will become apparent from the ensuing description, in which the invention is described in greater detail in terms of the exemplary embodiments shown in the drawing.

DESCRIPTION OF THE PREFERRED EMBODIMENTS

Figures 1A, 1B:
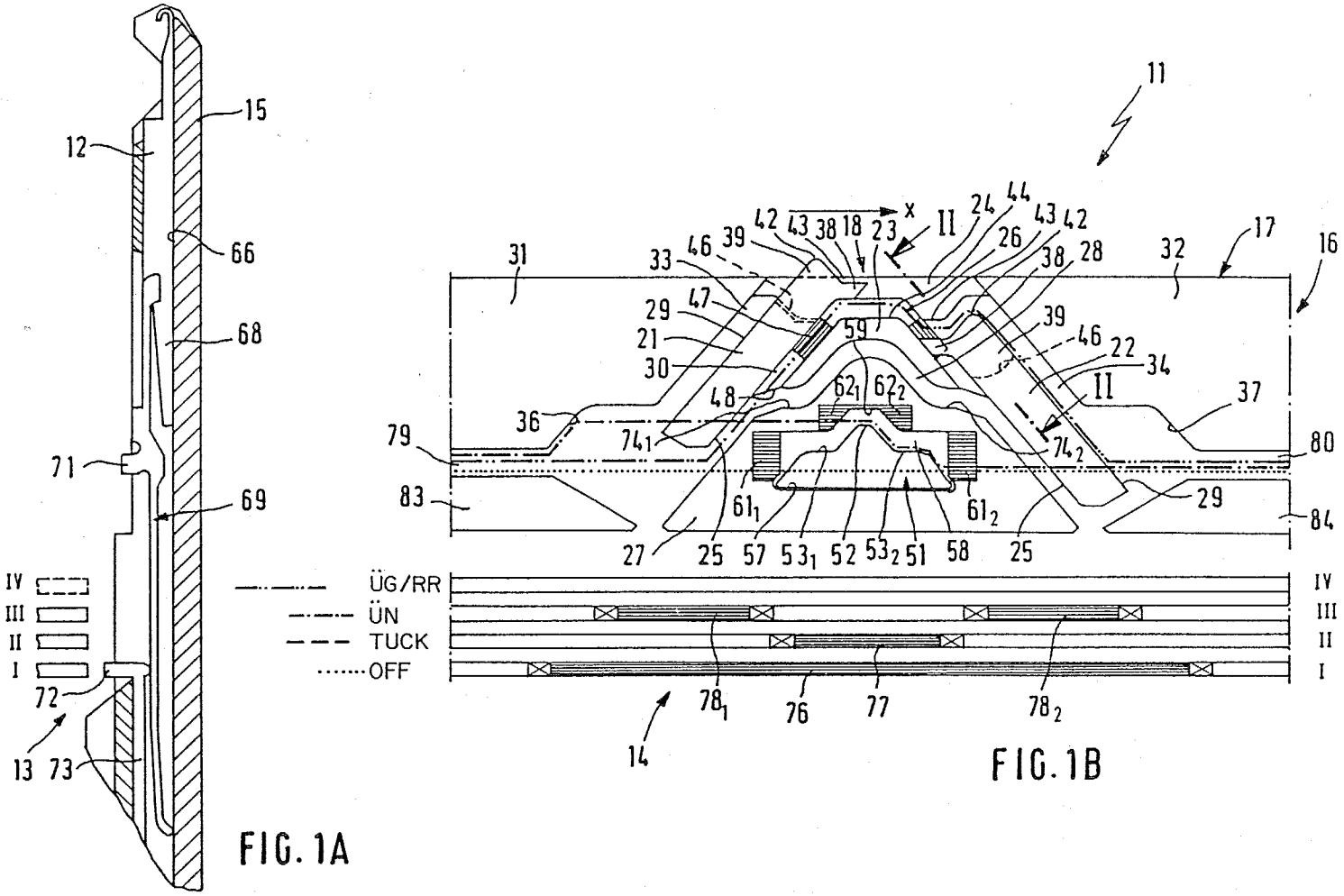
FIGS. 1A and 1B, respectively, show a fragmentary longitudinal section taken through a needle bed of a flat-bed knitting machine having a depressor apparatus for the needle butts, and a fragmentary plan view on a carriage provided with a cam system according to an exemplary embodiment of the present invention, seen above a needle bed of a flat-bed knitting machine, in which the operation of loop forming is illustrated.

The cam system 11 or 11' shown in the drawing for flat-bed knitting machines, of which only the cam on one needle bed 15 or 15', in this case the front needle bed, is shown, is movable by means of a carriage 16, 16' that travels back and forth in the direction of the arrows x and y. The front part of the cam system 11 or 11' that is shown here, which is identical to the rear portion of the cam system located symmetrically with respect to a longitudinal plane, has a needle cam unit 17, 17' below which is disposed a pressure bar or strip unit 14, 14' of a depressor apparatus 13, 13' for intermediate jacks 73, 73' connected to the needles, and at least one selector jack cam unit, not shown as well as at least two selector cam units, also not shown that are used for electromagnetic selection of the associated selector jacks acting upon the intermediate jacks 73, 73'. The needle cam unit 17, 17', which is symmetrical with respect to a transverse plane, is embodied as a combined knitting/loop transferring cam unit 18, 18' for both carriage travel and loop transferring directions, and accordingly has one knitting cam and one loop transferring cam combined or integrated therewith, the elements or cam parts of which are intermeshed with one another. The needle cam unit 17, 17' therefore does not require movable or indexable cam parts, except for the movable sinker elements 21, 22 or 21', 22' with which every cam system is provided.

As shown in FIG. 1B, the carriage 16 is provided with the cam system 11 that has the needle cam unit 17 and the pressure strip unit 14 of the depressor apparatus 13. The needle cam unit 17 has one or more combined or integrated knitting/loop transferring cams for both carriage travel and loop transferring directions, only one integrated knitting/loop transferring cam 18 of which is shown here.

The substantially symmetrically designed integrated knitting/loop transferring cam 18 has two spaced-apart sinker elements 21 and 22, slanted relative to one another and movable up and down in the direction of the double arrow A or B. Adjacent to or between their inner flanks 25, in the upper region, there is a stationary inverted channel-shaped or inverted roof-shaped cam part 23 that is to be associated with the transfer cam; with a fixed cam part 24 located above it. The cam part 23 forms part of a transfer track 26, on the one hand, and on the other hand, with a fixed cam part 27 located below it, it forms a knitting track 28. Spaced apart from and opposite the outer flanks 29 of the sinker elements 21, 22, wide, fixed cam parts 31, 32 are disposed in such a manner that in an upper region, together with the sinker elements 21, 22, they form a projection track 33, 34 for the transfer movement and in a lower region, by means of an undercut, they form a retraction flank 36 or 37 for the transfer movement.

Figures 2, 3:
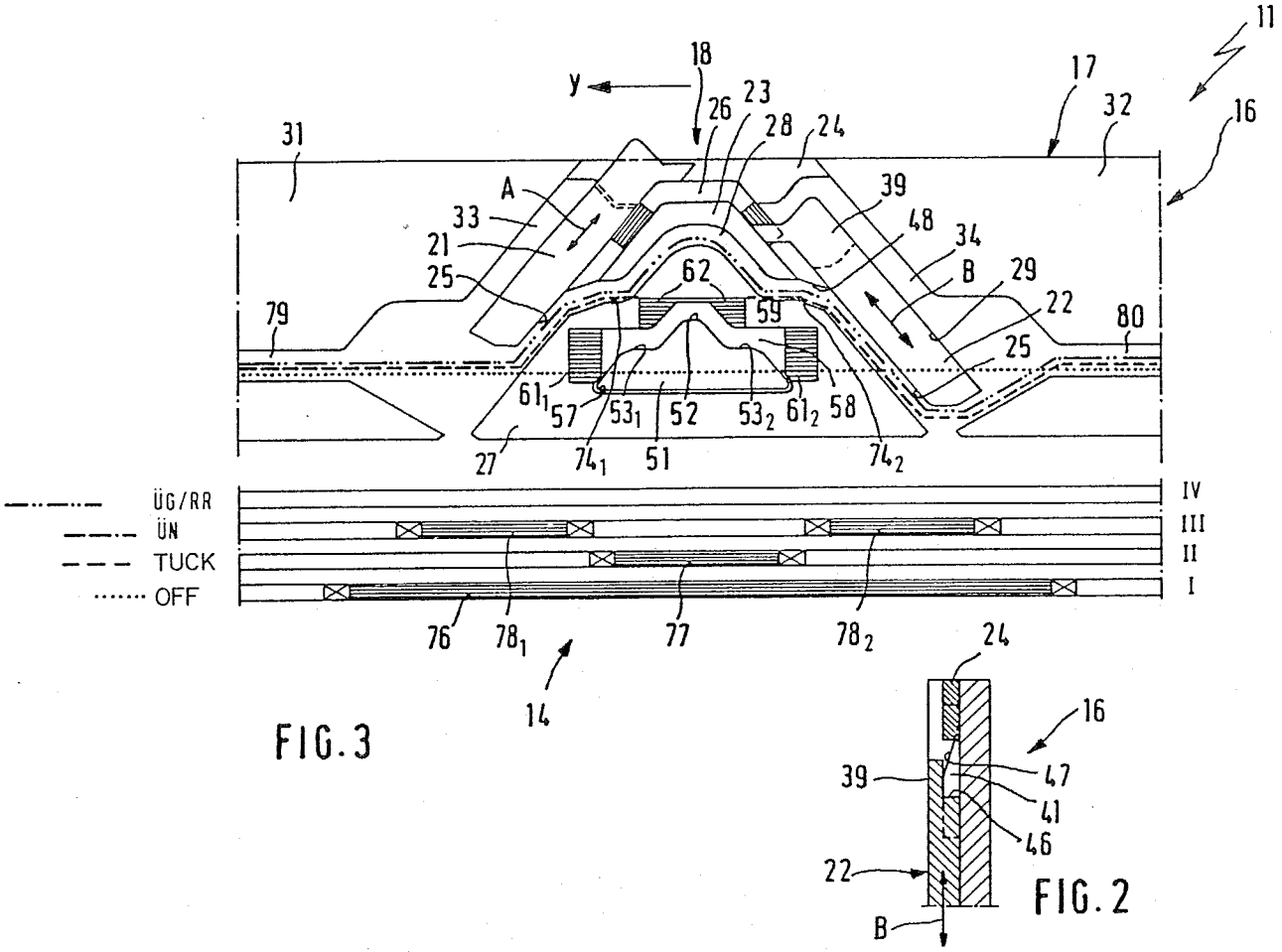
FIG. 2 is a section taken along the line II—II of FIG. 1B.
FIG. 3 is a fragmentary plan view on the carriage similar to that of FIG. 1B, but in which the operations of knitting and tucking are illustrated.

The sinker elements 21, 22 have a protrusion 38 projecting from their inner flank 25 at their upper end, the length of which is approximately equal to the width of the transfer track 26 or of its retraction track portion 30, which is formed between the inner flank 25 and the opposed roof-shaped cam part 23. An upper region 39 of the sinker elements 21, 22 having the protrusion 38 is provided with an undercut 41 (FIG. 2). The outer edge of the projecting upper region 39 extends in an undulating manner, such that toward the outer flank 29 a pre-tensioning lobe is formed, and the protrusion 38 adjoining it is capable of forming the insertion sinker 43 for the transfer movement.

As FIG. 1B shows, the sinker elements 21, 22 can essentially assume two positions, namely, a lower or lowered position (in this case the sinker element 22) and an upper or raised position (in this case the sinker element 21). The sinker elements 21, 22 have three or four tasks according to the present invention, namely, as a trailing sinker element as shown in FIG. 3 to sink the needles working in the "tuck" or "knitting" position for loop transfer. Furthermore, the sinker element 22 which is likewise in the lowered position but is in the leading position as shown in FIG. 1B also serves to force the needles 12 performing the transfer movement upward to the pre-tensioning lobe 42 and to shift them via the insertion sinker 43 to the transfer lobe 44, which is formed by the roof-shaped cam part 23. Third, the sinker elements 21, 22, in their raised, trailing position shown in FIG. 1B, serves to close the portion 30 of the transfer track that serves to retract the needles 12, which at that point have just transferred their loops. In this raised position, the projecting upper portion 39 formed by the undercut 41 fits over or covers the associated portion of the fixed cam part 24 located at a lower level. The protrusion 38 thereby contributes to defining the trailing portion of the transfer track 26 in the vicinity of the transfer lobe 44. As will be appreciated, the undercut 41 is embodied such that its bottom 46 has a shape that corresponds to the particular shape of the edge of the cam part 24, which for defining the transfer track 26 in the vicinity of the pre-tensioning lobe 42 and the insertion sinker 43 is located facing the upper portion 39 of the sinker elements 21, 22. In this raised position, the sinker element in the leading position as shown in FIG. 3 serves fourthly to free the projection portion of the knitting track 28 for working in the "tuck" or "knitting" position; this portion is defined by the stationary cam part 27 and the opposed inner flank 25 of the sinker sinker elements 21, 22.

As also shown in FIG. 1B, an oblique face 47 is disposed in the retraction track portion 30 of the transfer track 26, on both sides of the transfer lobe 44; in the trailing position this oblique face 47 enables movement across a limiting portion 48, located at a lower level, of the knitting track 28 at the point where the retraction track part 30 of the transfer track 26 opens into the knitting track 28.

Inside the middle fixed cam part 27 that is to be associated with the knitting cam, in a recess 57, there is a symmetrical fixed receiver cam element 51, which at its center has a receiver lobe 52 and on both sides has an intermediate step 53. Between this cam part 51 and an upper inner edge of the recess 57 of the fixed cam part 27, a receiving track 58 is formed. An oblique face 61 is disposed before the associated initial projection edge 59, and there is a respective oblique face 62 in a trailing position, that is, on both sides of the receiving lobe 52. The face 62 enables further passage of the receiving needles 12 in a horizontal direction at the level of the receiving lobe 52, underneath the cam part 27.

As FIG. 1B shows, the single transfer lobe 44, which thus is the same for both carriage travel directions x, y, is located substantially precisely above the lobe portion of the knitting track 28, which in turn is located above the lobe 52 of the receiving track 58.

FIG. 1A shows a conventional latch-type knitting needle 12 guided in the needle track 66 of the needle bed 15, which at its rear end portion 68 is pivotally connected to a needle jack 69. The needle jack 69 has a butt 71, which is capable of engaging the above-described tracks of the cam unit 18. The needle jack 69 is resiliently embodied and capable of being pressed into the needle track 66 in such a manner that in the pressed-in state the butt 71 is sunken in the needle track 66 while in the non-pressed-in state shown in FIG. 1A the butt 71 protrudes from the needle track 66. The needle jack 69 is pressed in by means of an intermediate jack 73 of the depressor apparatus 13, the butt 72 of which can be selectively moved into the four various planes or tracks of the pressure strip unit 14 and pressed in thereby via selector jacks, not shown, of an electromagnetic selection unit, likewise not shown.

FIG. 1B shows the pressure strip unit 14 of the cam system 11 with the four different planes I-IV, in which pressure strips 76, 77 and 78 are disposed, which have the effect that in their vicinity the butt 72 of the intermediate jack 73 is pressed into the needle track 66, so that the butt 71 of the needle jack 69 disappears in the needle track 66 and thus cannot come into engagement with a track in the cam system or be pressed out of a track and possibly disappear underneath a cam part.

Figure 1C:
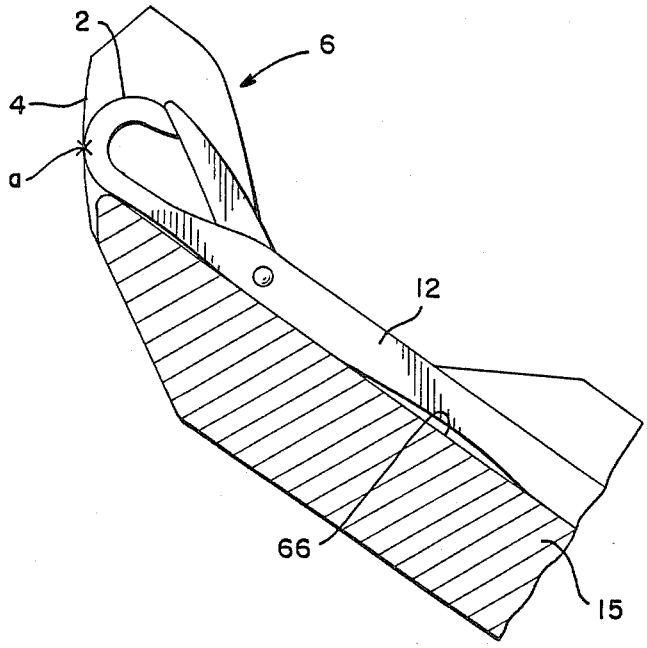
FIG. 1C is a partial cross-sectional view to an enlarged scale of detail A of FIG. 1A.

FIG. 1B shows the mode of operation of the cam system 11 for the loop forming movement in one carriage travel direction A, assuming that the leading sinker element 22 is in the lowered position and the trailing sinker element 21 is for instance raised to the level such that the curved edge 2 of the needle 12 is tangent at point a to the knock-over edge 4 of the knock-over comb 6 (FIG. 1C). Furthermore, the intermediate jack 73 must be displaced by the selector unit, not shown, and by the leading parts of the cam system, which are also not shown, in such a manner that the butt 72 is moved out of the AUS (i.e., OFF) track I, for instance on the front needle bed 15, into the UG (i.e., loop transferring) track IV and into the UN (i.e., receiving) track III, for instance on the rear needle bed. The other tracks are shown in dash lines with double dots for the transfer UG and in dash lines with single dots for the reception UN.

Subsequently, the transfer movement of the needle jack butt 71 takes place after passage through a leading track section 80, defined by the cam part 32 and by the further, fixed cam part 84 located below it, to the leading outer flank 29 of the sinker element 22, specifically moving upward thereon, over the leading pre-tensioning lobe 42 and the leading insertion sinker 43, to the transfer lobe 44, where the loop is transferred to the receiving needle on the rear needle bed. The needle of the front needle bed 15 is then retracted along the retractor track portion 30 of the transfer track 26 via the oblique face 47, with the effect being that the needle jack butt 71 can move away via the limiting region 48 into the knitting track 28 and from there can move out horizontally underneath the trailing retractor part 21 through the track section 79, which is defined by the cam part 31 and by a further, fixed cam part 83 located below it. As the drawing shows, there is no pressure strip in the track IV, so that the needle jack 71 always remains in the associated track.

The reception movement in the rear needle bed, for instance, takes place in such a way that the needle jack butt 71 likewise enters the track section 80 and, in front of the outer flank 29 of the leading retractor part 22, is pressed by the leading pressure strip $78_2$ in the track III into the needle track 66, so that it can continue on underneath the retractor part in the horizontal direction. The needle jack butt 71 is depressed as far as the oblique face $61_2$, along which the butt 71 plunges into the reception track 58, or its projection part, and from there is guided via the leading intermediate step $53_2$ to the receiving lobe 52. According to the invention, the needle jack butt 71 now remains at the level of the receiving lobe 52, because it comes to rest on the trailing oblique face $62_1$ which presses the butt 71 into the needle bed 15, or into the needle track 66, so that it passes underneath the cam part 27 and continues on through. The passage underneath the knitting track 28 and the trailing sinker element 21 is made possible by the trailing pressure strip $78_1$. At the end of this trailing pressure strip $78_1$, the needle jack butt 71 can emerge once again, where it meets the retractor flank 36 of the trailing, fixed cam part 31 and from there enters the track section 79. In other words, after it has received the loop from the transferring needle and long after the transferring needle has been retracted, the receiving needle remains at the level of the receiving lobe 52, which assures that the loop is transferred more gently.

FIG. 3 shows the mode of operation of the 3-way technique, that is, at "knitting" (RR), "tuck" and AUS (OFF), which for the sake of simplicity is shown in the opposite direction of carriage travel y. The position of the sinker elements 21, 22 remains the same as in FIG. 1B, except that now the sinker element 21 is leading. During knitting, that is, transferring a loop, the selector jack butt 72 is in the track IV, so that the needle jack butt 71 enters the leading track section 79, and from there enters the knitting track 28, initially projecting it and then retracting it as it passes through in accordance with its path, and then at the lower edge of the trailing sinker element 22 executes a sinking movement and from there enters into the trailing track section 80. When operating in the "tuck" mode, the intermediate jack butt 72 is moved into the track II, in which a pressure strip 77 is centrally disposed. In other words, beginning at the leading track section 79 the needle jack butt 71 enters into the knitting track 28, where after reaching an intermediate step $74_1$ it is depressed by the pressure strip 77, so that it is guided underneath the fixed cam part 27 until it has reached the trailing intermediate step $74_2$ in the knitting track 28. From there, a retracting and sinking movement again takes place, by means of the trailing sinker element 22.

Non-knitting, in accordance with the OFF track I, is effected in that the needle jack butt 71 is continuously depressed, by means of the pressure strip 76 acting upon the intermediate jack butt 72, between the leading and trailing track sections 79 and 80, respectively.

Figures 4A, 4B:
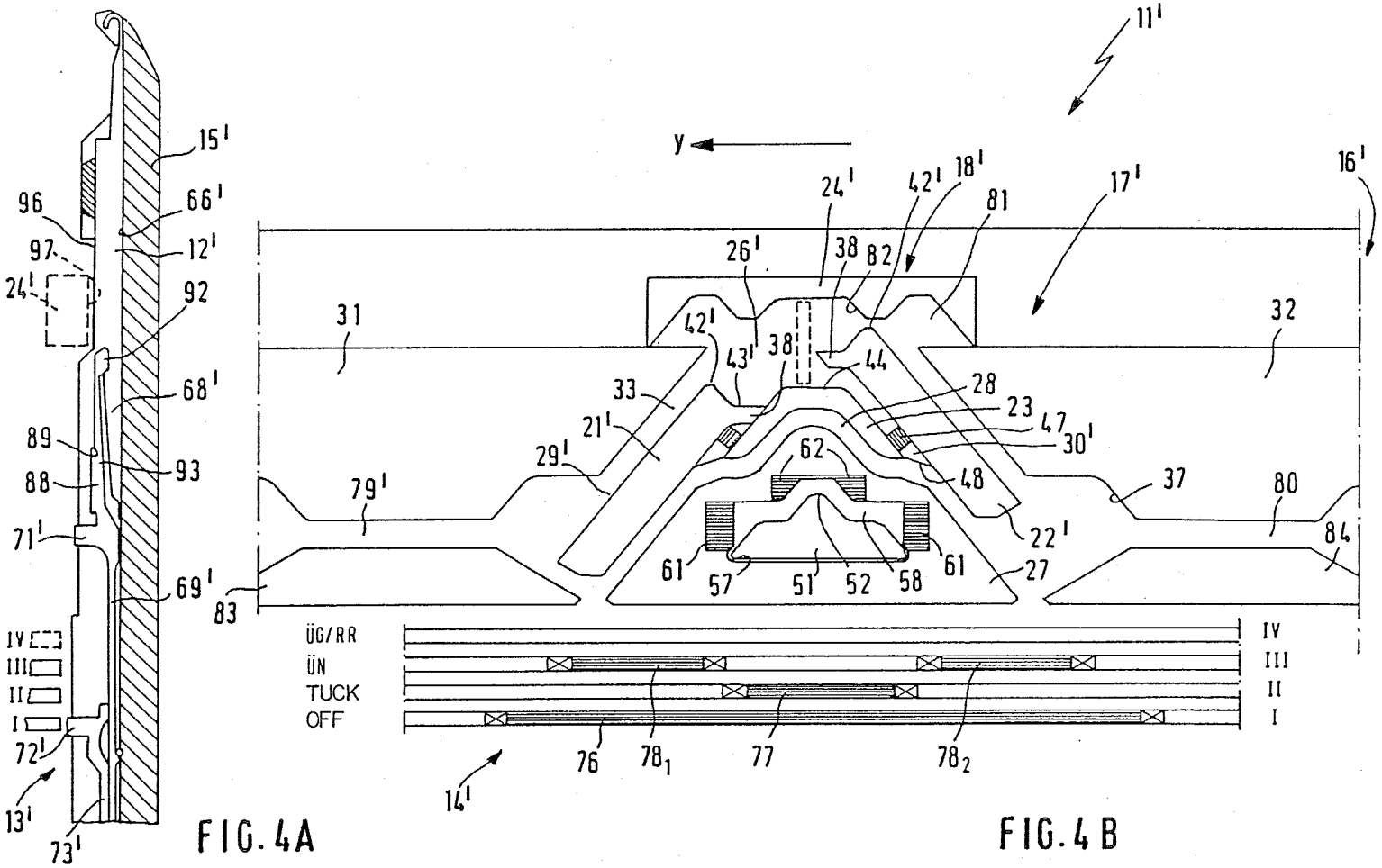
FIGS. 4A and 4B, respectively, are views similar to those of FIGS. 1A and 1B but of a different exemplary embodiment of the present invention.

The cam system 11' shown in FIG. 4B, according to a different exemplary embodiment of the present invention, also has a needle cam unit 17', which preferably includes a plurality of integrated knitting and loop transferring cams 18'. The above-mentioned cam parts of the knitting/loop transferring cam 18' are substantially the same in structure as the knitting/loop transferring cam 18 of the exemplary embodiment of FIGS. 1B and 3, with the exceptions that, first, the fixed cam part 24' is bridge-like in structure and is placed at a higher level than the cam part 24 of the first exemplary embodiment, and, second, the sinker elements 21' and 22' do not have any undercut. Also, the oblique faces 47 in the transfer track 26' are kept shorter. In FIG. 4B, therefore, only the reference numerals that pertain to elements embodied differently from the corresponding ones of the first exemplary embodiment are provided with a prime.

As shown in FIG. 4B, the fixed cam part 24' is disposed a considerable distance above the roof-like cam part 23, spanning the two cam parts 31 and 32 in bridge-like fashion, and is disposed such that there is still room in the intermediate space 81 for the sinker elements 21, 22, even in its raised position, so that the sinker element and the cam part 24' do not overlap. As will be described below, the cam part 24', with its underside oriented toward the needle bed 15', projects beyond the underside of the other cam parts. The inside contour 82 of the cam part 24' corresponds to the curved shape of the upper edge of the sinker element 21', the roof-like cam part 23 and the sinker element 22'. As a result, there is a wide transfer track 26, in which the needle jack 69' and the needle 12', which are embodied differently from those of the first exemplary embodiment, are guided.

As shown in FIG. 4A, the latch-type knitting needle 12' is again pivotably connected, with its arm 93, with the rear end portion 68' of the needle jack 69' by means of a coupling-like holder 92. The needle jack 69' is provided with a needle jack butt 71'. Immediately adjacent thereto, on the side oriented toward the needle 12', there is a fore butt 88, with a stop edge 89. The needle jack 69' can be acted upon by an intermediate jack 73', or can be pressed into the needle track 66' (FIG. 4A), the butt 72' of which is moved into the various tracks of the pressure strip unit 14' and there can be acted upon during operation by the pressure strips 76–78[1] which are disposed in the same manner.

The fore butt 88 provided in addition to the butt 71' of the needle jacks 69' comes into effect only during the transfer movement of the loop forming operation, in the following manner: Since as shown in FIG. 4B the sinker elements 21' and 22' are disposed such that loop transfer can take place in the carriage travel direction y, the needles 12' that are intended for transfer enter the leading track 79', with their undepressed needle jack butt 71' (since the butt 72' is in track IV) and are projected at the outer flank 29' of the leading sinker element 21'. Since the fore butt 88 is always disposed in the needle track 66', it moves underneath the leading fixed cam part 31, until with its stop edge 89 it meets the inside contour 83 of the fixed cam part 24', which is located at a lower level than the other cam parts or has a greater thickness than they do. In any case, the underside 94 of the fixed cam part 24' protrudes into a longitudinally extending recess 96 (FIG. 4A) provided in the needle bed 15'. In other words, the downward movement of the needle 12', beginning at the leading pre-tensioning lobe 42' and extending into the insertion sinker 43', is effected as a result of the contact of the stop edge 89 of the fore butt 88 with the associated section of the parallel inside contour 82 of the fixed cam part 24'. The ensuing projection movement from the insertion sinker 43' to the transfer lobe 44 is again effected by the movement of the needle jack butt 71' along the roof-like cam part 23. The entry into the retractor track part 30' between the roof-like cam part 23 and the inner flank of the trailing sinker element 22' takes place in the corresponding section of the track 81 by means of the needle jack butt 71' and the fore butt 88 of the needle. The situation is equivalent for the transfer movement in the opposite carriage travel direction x and for correspondingly displaced sinker elements.

Since the fixed bridge-like cam part 24' is the only part that engages a groove in the needle bed 14' or in other words is introduced into the needle bed, the fore butt 88 comes into play only during the transfer movement of the loop, but not during knitting, receiving, tucking or in a non-working mode. As noted, the pressure strip unit 14' is embodied in exactly the same way as in the first exemplary embodiment. The other modes of operation also follow the same course as in the first exemplary embodiment.

What is claimed is:

1. A cam system for a flat-bed knitting machine, having a reciprocating carriage, at least one needle bed defining a needle track, a needle supported in each needle track, said needles each having a needle jack associated therewith, a depressor apparatus having pressure jacks each with a pressure foot for acting on a needle jack, and a pressure strip unit, the cam system comprising a needle cam unit in which a knitting track and a transfer track are defined, said needle cam unit including:

a receiving cam part having a central receiving lobe;

a fixed cam part having an oblique face operative in a trailing manner; and at least one integrated knitting/loop transfer cam, for both carriage travel and loop transferring directions, having spaced apart, adjustable, sinker elements, a transfer cam part defining a central lobe situated above the knitting track, said sinker elements including an outer flank surface and a pre-tensioning lobe situated in a leading position relative to the central lobe for pre-tensioning the loops on the sinker elements, said pre-tensioning lobe being operative in the lowered position of the sinker element, wherein:

the sinker elements are embodied such that in a leading and lowered position, they define a projection track to the transfer cam part, and in a trailing and raised position or in a sinking position, beginning at the central lobe they completely define a retractor track section of the transfer track; and the oblique face of the fixed cam part is disposed at the same level as the central receiving lobe at a given time of the receiving cam movement and leads at the same level out of the receiving track along a substantially horizontal track, which as a result of a subsequently operative pressure strip of the pressure strip unit, extends beyond the outer flank surface of the trailing sinker element.

2. The cam system as defined in claim 1, further wherein:

an oblique face is situated in the retractor track section of the transfer track before the entry of the retractor track into the knitting track.

3. The cam system as defined in claim 1, further wherein:

each sinker element includes a protrusion forming an insertion sinker which trails after the pre-tensioning lobe, said protrusion, in the lowered position of the sinker element, closing the retractor track section and in the raised position, being disposed above said central lobe.

4. The cam system as defined in claim 1, further including:

a further fixed cam part which partly defines the transfer track, further wherein:

each sinker element includes, in an upper region thereof, a protrusion and an undercut which is engaged by said further fixed cam part in the raised position of the sinker element.

5. The cam system as defined in claim 1, further having:

at least one standard-height butt and at least one half-height butt, further wherein:

each needle bed is provided with a recess along a working region for the half-height butt;

the half-height butt is disposed sunken in its associated needle track; and the needle bed recess is engaged, during the longitudinal movement of the carriage by the fixed cam part, said fixed cam part having a bridge-like embodiment and being located opposite and spaced apart from their sinker elements and the transfer part.

* * * * *